US006742949B2

(12) United States Patent
Youn

(10) Patent No.: US 6,742,949 B2
(45) Date of Patent: Jun. 1, 2004

(54) PAPER DISCHARGING APPARATUS OF INK-JET PRINTER

(75) Inventor: Karp-Sik Youn, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 22 days.

(21) Appl. No.: 10/073,152

(22) Filed: Feb. 13, 2002

(65) Prior Publication Data

US 2003/0031495 A1 Feb. 13, 2003

(30) Foreign Application Priority Data

Aug. 7, 2001 (KR) ..... 10-2001/0047411

(51) Int. Cl.[7] ..... B65H 29/34; B65H 29/26; B41J 13/10

(52) U.S. Cl. ..... 400/647.1; 400/647; 400/646; 271/213; 271/214

(58) Field of Search ..... 271/189, 218, 271/213, 214; 400/646, 647, 647.1; 347/104

(56) References Cited

U.S. PATENT DOCUMENTS 5,767,884 A * 6/1998 Bortolotti et al. ..... 347/102
5,921,690 A * 7/1999 Shinmachi et al. ..... 400/625
6,250,628 B1 * 6/2001 Klaus ..... 271/218
6,293,543 B1 * 9/2001 Lawrence ..... 271/213
6,581,922 B2 * 6/2003 Kuwata et al. ..... 270/58.11
2003/0170063 A1 * 9/2003 Yoshihara ..... 400/578

FOREIGN PATENT DOCUMENTS

DE 4223344 A1 * 1/1993 ..... B41J/13/10
JP 03026655 A * 2/1991 ..... B65H/29/34
JP 06100226 A * 4/1994 ..... B65H/31/00
JP 08026558 A * 1/1996 ..... B65H/29/34
JP 10330011 A * 12/1998 ..... B65H/31/20

OTHER PUBLICATIONS

Machine translation of JP 10330011 A, Yamamoto et al.*

* cited by examiner

*Primary Examiner*—Daniel J. Colilla
(74) *Attorney, Agent, or Firm*—Robert E. Bushnell, Esq.

(57) ABSTRACT

A sheet discharging apparatus of a printer has a tray on which printed paper is consecutively stacked, holders for supporting the printed paper above the tray, a rack reciprocating in a direction perpendicular to a sheet discharging direction "A" by the driving of a motor, and levers connecting the holders with the rack and pivoting in association with a movement of the rack. The holders horizontally move above the tray in association with a reciprocal movement of the rack, thereby supporting printing media of various widths above the tray.

17 Claims, 5 Drawing Sheets

PAPER DISCHARGING APPARATUS OF INK-JET PRINTER

CLAIM OF PRIORITY

This application makes reference to, incorporates the same herein, and claims all benefits accruing under 35 U.S.C. §119 from an application for PAPER DELIVERY DEVICE OF INK-JET PRINTER earlier filed in the Korean Industrial Property Office on Aug. 7, 2001, and there duly assigned Serial No. 47411/2001 by that Office.

BACKGROUND OF THE INVENTION

1. Technical Field

The present invention relates to a sheet discharging apparatus of a printer, and more particularly, to a sheet discharging apparatus that permits ink printed on the sheet to dry by delaying stacking the discharged printed sheet.

2. Related Art

In a general ink-jet printer, sheets of printed paper are discharged and then constantly stacked on a tray. As a printing speed of an ink-jet printer has increased, a speed of stacking discharged sheets of printed paper on a tray has increased. The increased speed of stacking causes the printed sheet to be stacked on the tray before ink on a previously printed sheet is dried. Therefore, ink printed on a sheet of lower-stacked paper is smeared over a back of upper-stacked paper.

In order to solve the above problem, there has been a known printer which delays stacking the discharged sheet. U.S. Pat. No. 4,794,859 discloses an active paper drop for printers which has a pair of opposed, movable rail members associated with opposed walls of a horizontal-disposed output collection tray for receiving sheets of printed media. Each rail member has a return spring that act to maintain the rails in a closed position. In that position, the rails support a sheet of the print medium during the printing operation, thus giving the ink on the previously printed-on sheet time to dry. The rails are provided with a wing member and are pivotally secured in the floor of the output tray, with the pivot point spaced inwardly from the wing member. Downward pressure against the wing member thus causes the rail to rotate outward from its closed position, into a recess formed in the side of the output tray. This provides sufficient clearance for the sheet to drop into the output stack. Upon release of the downward pressure, the spring causes the rail member to return to its original closed position.

According to the conventional sheet discharging apparatus, however, since the holders pivot upwardly and downwardly without a variation in a distance between the holders, printing media such as a post card having a smaller width than a distance between the pair of holders cannot be supported. Therefore, when the printing media having the smaller width is sequentially printed, the conventional sheet discharging apparatus cannot solve the above problem.

In addition to that, the holders in the conventional sheet discharging apparatus are exposed from the vertical wall of the tray when the printer stands by for printing a sheet. Therefore, there is a problem of that the holders are damaged by an external shock.

SUMMARY OF THE INVENTION

It is therefore an object of the present invention to provide an improved printer.

It is another object to provide for an improved sheet discharging apparatus.

It is further an object to provide a sheet discharging apparatus capable of supporting printing media of various widths by adjusting a distance between holders.

It is a still further object to provide a sheet discharging apparatus in which the holders are not exposed to an external shock when the printer stands by for printing a sheet.

It is yet a further object to provide a sheet discharging apparatus that allows a size of the printer body to be reduced.

The discharging apparatus having features of the present invention may be constructed with a tray on which printed sheet is stacked, a holder supporting said printed sheet above said tray, and a moving means for moving said holder in a direction perpendicular to a sheet discharging direction.

The moving means includes a motor, a rack reciprocating in a direction perpendicular to a sheet discharging direction according to the driving of the motor, and a pinion connected to an end of a rotary shaft of the motor and engaged with the rack. The holder horizontally moves above the tray in association with a movement of the rack.

The holder and the rack are connected to each other through a lever which pivots in the sheet discharging direction in association with the movement of the rack. At an end of the lever is mounted a driven gear engaged with the rack, and at the other end of the lever is formed a protrusion inserted into a guide slot which is formed in the holder.

It is preferable that a spring is interposed between the holder and the lever for biasing the lever to pivot toward the sheet discharging direction.

According to the sheet discharging apparatus as constructed above, the holder horizontally moves above the tray, thereby supporting printing media of various widths above the tray.

BRIEF DESCRIPTION OF THE DRAWINGS

The aforementioned object and characteristic of the present invention will be more apparent by describing a preferred embodiment of the present invention in greater detail with reference to accompanied drawings, in which.

DESCRIPTION OF THE PREFERRED EMBODIMENT

A preferred embodiment of the present invention will be described in greater detail with reference to the accompanied drawings.

Figure 1:
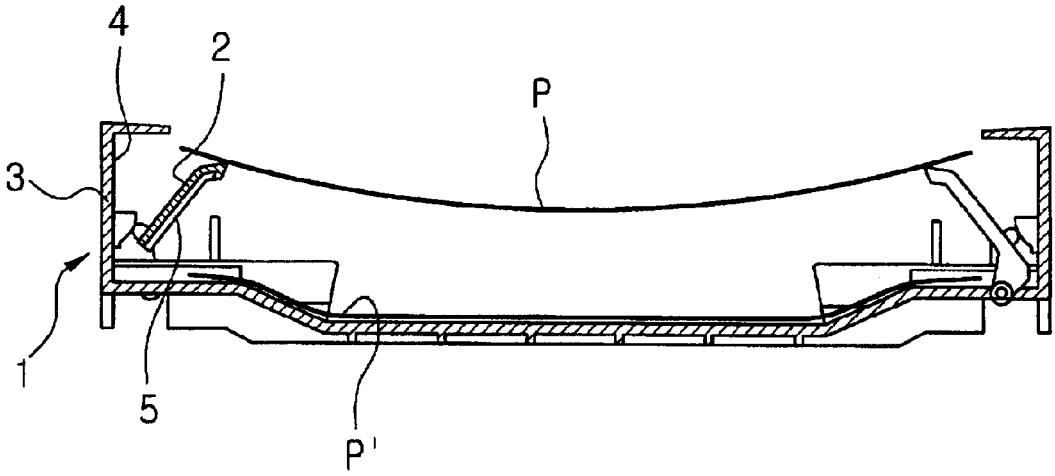
FIG.1 (PRIOR ART)
FIG. 1 is a front section view showing a conventional sheet discharging apparatus.

As shown in FIG. 1, a conventional paper discharging apparatus has a tray 1 on which printed paper is stacked, and a pair of holders or supporting members 2 pivotally disposed on a bottom surface of the tray 1, for holding a sheet of printed paper "P".

The holders 2 pivot between an open position wherein each of the holders 2 fit into a recess 4 formed on a vertical wall 3 of the tray 1 and a close position wherein each of the holders 2 leans out of the vertical wall 3 at a predetermined angle. The holder 2 is provided with a return spring 5 for returning the holder 2 to the close position. In the close position, the holders 2 support the sheet of printed paper "P" above the tray 1 during a printing operation, thereby allowing ink printed on the sheet of printed paper "P'" previously stacked on the tray 1 to dry.

Figure 2:
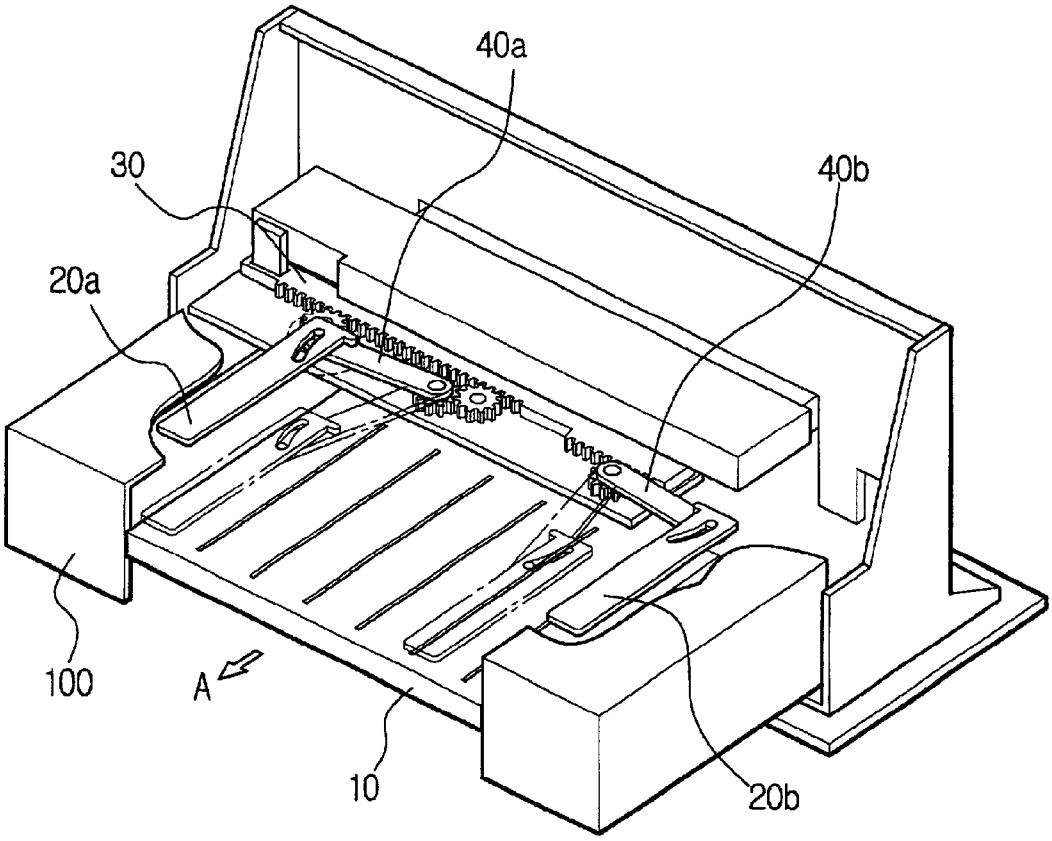
FIG. 2 is a schematic perspective view showing an ink-jet printer employing a sheet discharging apparatus in accordance with the present invention.

As shown in FIG. 2, a sheet discharging apparatus includes a tray 10 on which sheets of printed paper are consecutively stacked, a first holder 20*a* and a second holder 20*b* which are opposed, spaced apart, and respectively mounted at both sides of the tray 10, for supporting sheets of printed paper, a rack 30 reciprocating in a direction perpendicular to a sheet discharging direction "A" to horizontally move the first and the second holders 20*a* and 20*b* above the tray 10, and a first lever 40*a* and a second lever 40*b* connecting the first and the second holders 20*a* and 20*b* to the rack 30, respectively.

When the first and the second holders 20*a* and 20*b* stand by for printing a sheet, they are within a case 100. As the first and the second levers 40*a* and 40*b* pivot, on hinge shafts 42*a* and 42*b*, toward a center of the sheet discharging direction "A", the first and the second holders 20*a* and 20*b* are exposed out of the case 100. In this position, the first and the second holders 20*a* and 20*b* support the printed sheet and keep it elevated above the tray 10, thus giving the ink on the previously printed-on sheet time to dry.

Figure 3:
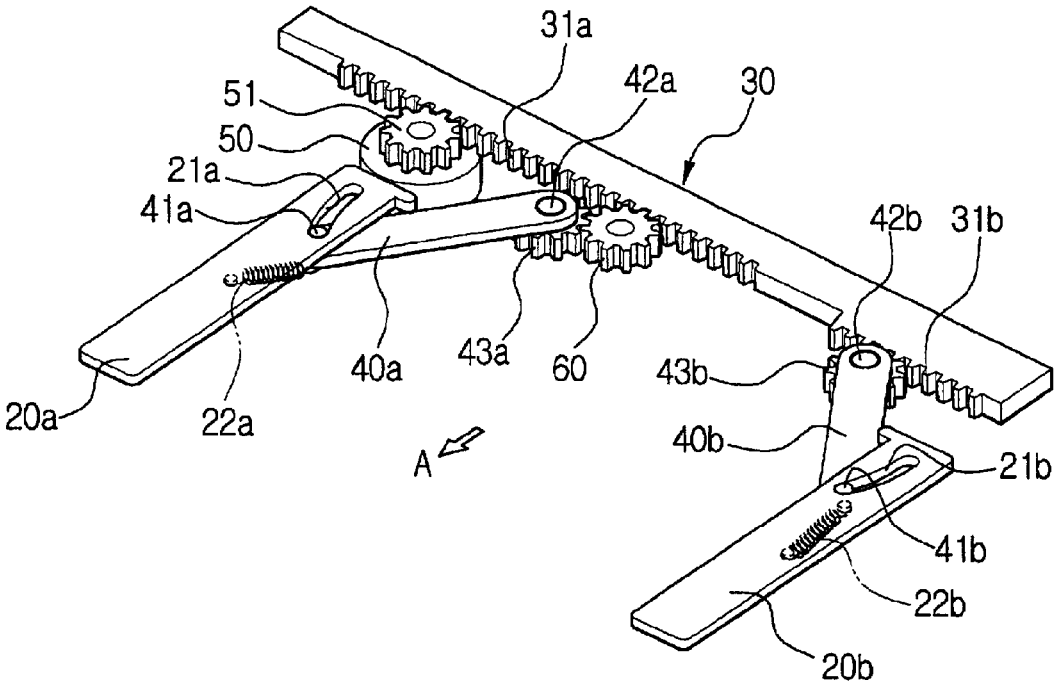
FIG. 3 is a perspective view showing a driving mechanism of the sheet discharging apparatus of FIG. 2.

As shown in FIG. 3, in an inside of the printer body is mounted a motor 50 as a driving source for driving the rack 30. At an end of a rotary shaft of the motor 50 is mounted a pinion 51 engaged with teeth of the rack 30. The pinion 51 receives a motion transferred from the motor 50 and transfers the motion to the rack 30. The pinion 51 rotates both in a normal and a reverse direction, i.e., left and right, so that the rack 30 moves in a direction perpendicular to the sheet discharging direction "A".

The first and the second holders 20*a* and 20*b* have guide slots 21*a* and 21*b* respectively which are rounded toward a center of the tray 10.

The first and the second levers 40*a* and 40*b* are mounted pivotally on the hinge shafts 42*a* and 42*b*. At ends of the respective first and second levers 40*a* and 40*b* are provided driven gears 43*a* and 43*b* formed integrally with the first and the second levers 40*a* and 40*b*. On the other ends of the first and the second levers 40*a* and 40*b* are formed protrusions 41*a* and 41*b* which are inserted into the guide slots 21*a* and 21*b* of the first and the second holders 20*a* and 20*b*. The first lever 40*a* is indirectly connected to the rack 30 in a manner that the driven gear 43*a* is engaged with an idle gear 60 engaged with the rack 30. The second lever 40*b* is directly connected to the rack 30 in a manner that the driven gear 43*b* is engaged with the rack 30. Due to the presence of the idle gear 60 interposed between the first lever 40*a* and the rack 30, the first and the second levers 40*a* and 40*b* symmetrically pivot in association with the movement of the rack 30 at the same time.

Means for elastically biasing the first and the second levers 40*a* and 40*b* in favor of pivoting are provided. As shown in FIG. 3, torsion springs 22*a* and 22*b* bias the first and the second levers 40*a* and 40*b* in the sheet discharging direction "A". The spring motion may be achieved by a variety of ways, such as with coil or leaf springs and the like.

The rack 30, a toothed bar, includes first gear teeth 31*a* and second gear teeth 31*b*. The first gear teeth 31*a* are engaged with the idle gear 60 connected to the first lever 40*a*. The second gear teeth 31*b* are engaged with the driven gear 43*b* connected to the second lever 40*b*. Where the first gear teeth 31*a* are indirectly connected to the first lever 40*a* through the idle gear 60 and the second gear teeth 31*b* are directly engaged with the second lever 40*b*, the second gear teeth 31*b*. compared with the first gear teeth 31*a*, protrude in the sheet discharging direction "A" as much as a space between the rack 30 and the end of the first lever 40*a*. This protrusion makes it possible for front ends of the first and second holders 20*a* and 20*b* to correspond to each other. It is also preferred that a length of the first gear teeth 31*a* is longer than that of the second teeth 31*b*.

Figure 4:
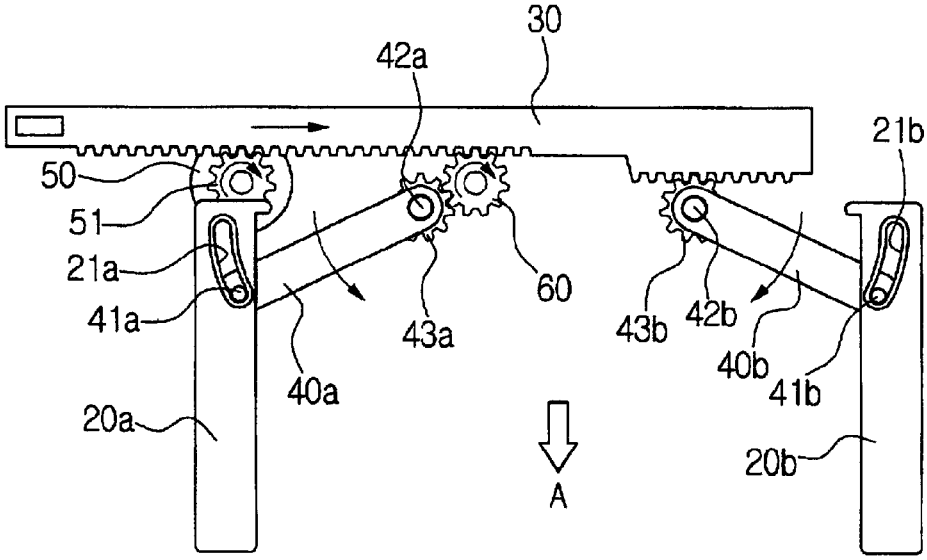
FIG. 4 is a plan view showing a rack starting to move in the sheet discharging apparatus of FIG. 2.
Figure 5:
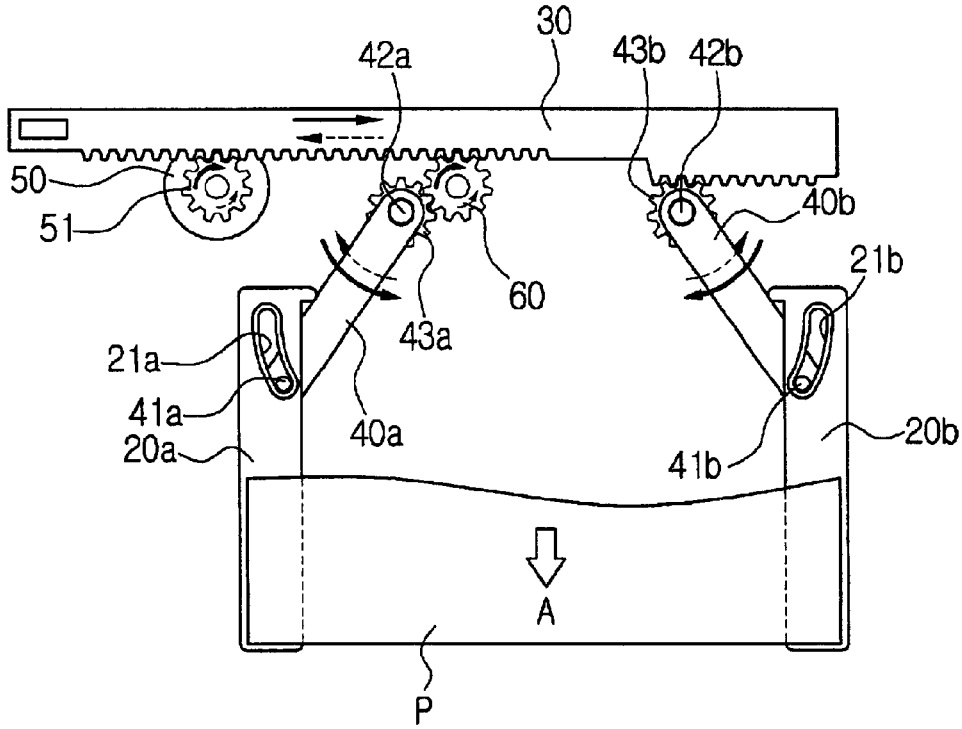
FIG. 5 is a plan view showing the rack being moved further than that of FIG. 4.
Figure 6:
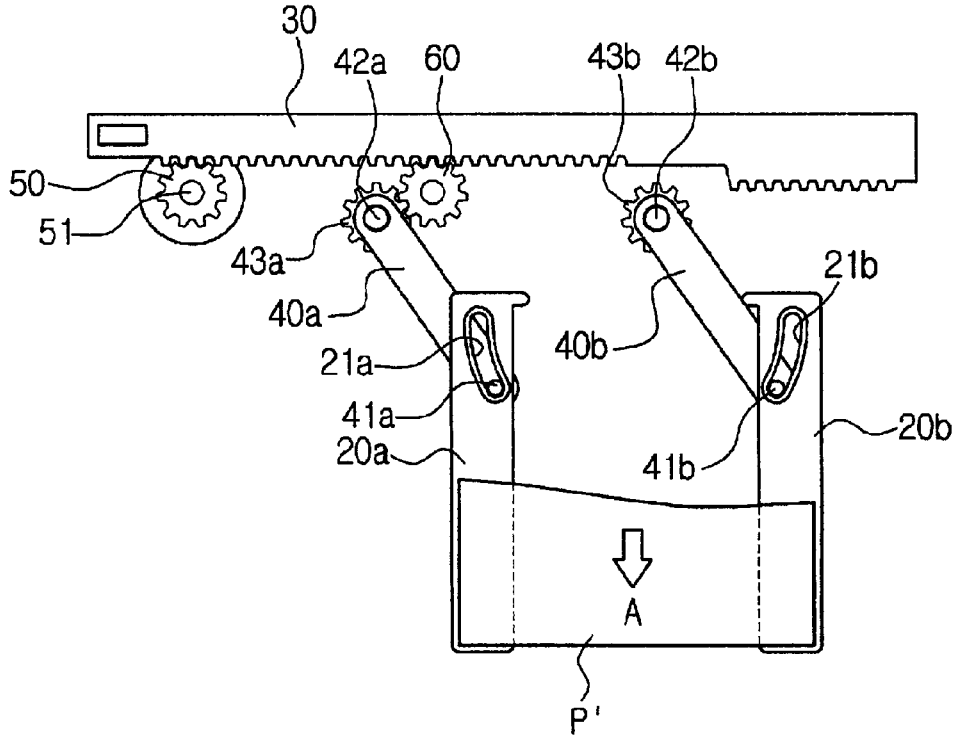
FIG. 6 is a plan view showing the rack being moved further than that of FIG. 5.

With reference to FIGS. 4 through 6, an operation of the sheet discharging apparatus according to the present invention will be described.

When the printer stands by to print a sheet, the first and the second levers 40*a* and 40*b* are fit into in the case 100 as shown in FIG. 2. When the printer starts printing, the motor 50 rotatably drives the pinion 51 in a normal direction (illustrated by solid arrows in FIGS. 4 and 5), so that the rack meshed into the pinion 51 starts to move in a right direction (illustrated by solid arrows in FIGS. 4 and 5). When the rack 30 moves in the right direction, the idle gear 60 meshed with the rack is rotated in the normal direction. Due to the rotation of the idle gear 60, the first lever 40*a* pivots on the hinge shaft 42*a* in a counterclockwise direction. The second lever 40*b* pivots on the hinge shaft 42*b* in a clockwise direction due to the movement of the rack 30.

As shown in FIG. 4, each of the protrusions 41*a* and 41*b* moves along the respective guide slots 21*a* and 21*b* of the first and the second holders 20*a* and 20*b*, so that the first and second levers 40*a* and 40*b* pivot toward a center of the sheet discharging direction "A" as much as lengths of the guide slots 21*a* and 21*b*. At this point, the springs 22*a* and 22*b* elastically recover to allow the first and the second levers 40*a* and 40*b* to easily pivot.

If the rack 30 moves further in the right direction, the first and the second levers 40*a* and 40*b* pivot further toward the center of the sheet discharging direction "A" as shown in FIG. 5. Due to the pivotal movements of the first and the second levers 40*a* and 40*b*, the first and the second holders 20*a* and 20*b* escape from the case 100 (refer to FIG. 2) to be positioned above the tray 10. In this position, the first and the second holders 20*a* and 20*b* support a sheet of paper "P" and keep it elevated above the tray 10.

At the termination of printing and discharging of the sheet "P", the motor 50 drives the pinion 51 in a reverse direction (illustrated by dotted arrows in FIG. 5), so that the rack 30 meshed into the pinion 51 starts to move in a left direction (illustrated by dotted arrows in FIG. 5). Accordingly, the first lever 40*a* pivots in a clockwise direction and the second lever 40*a* pivots in a counterclockwise direction. Due to the pivotal movements of the first and the second levers 40*a* and 40*b*, the first and the second holders 20*a* and 20*b* return to be received in the case 100 as shown in FIG. 2. At this point, the torsion springs 22*a* and 22*b* stretch. Accordingly, the torsion springs 22*a* and 22*b* prevents the protrusions 41*a* and 41*b* of the first and the second levers 40*a* and 40*b* from radically moving along the guide slots 21*a* and 21*b*, so that the first and the second holders 20*a* and 20*b* move along a nearly linear track and are received in the case 100. Then, the paper "P" being supported by the first and the second holders 20*a* and 20*b* drops onto the tray 10 to be stacked.

If the motor 50 further drives the pinion 51 in the state of FIG. 5 in the normal direction, the rack 30 further moves in the right direction. The further movement of the rack 30, as shown in FIG. 6, makes the first lever 40*a* further pivot in the counterclockwise direction to be positioned near to the second lever 40*b*. Since the driven gear 43*b* of the second lever 40*b* is positioned at an ending point of the second gear teeth 31*b* of the rack 30 as shown in FIG. 5, the second lever 40*b* does not pivot any further although the rack 30 moves further. Thus, a distance between the first and the second holders 20*a* and 20*b* becomes narrow, thereby supporting the paper "P" having a narrow width.

Figure 7:
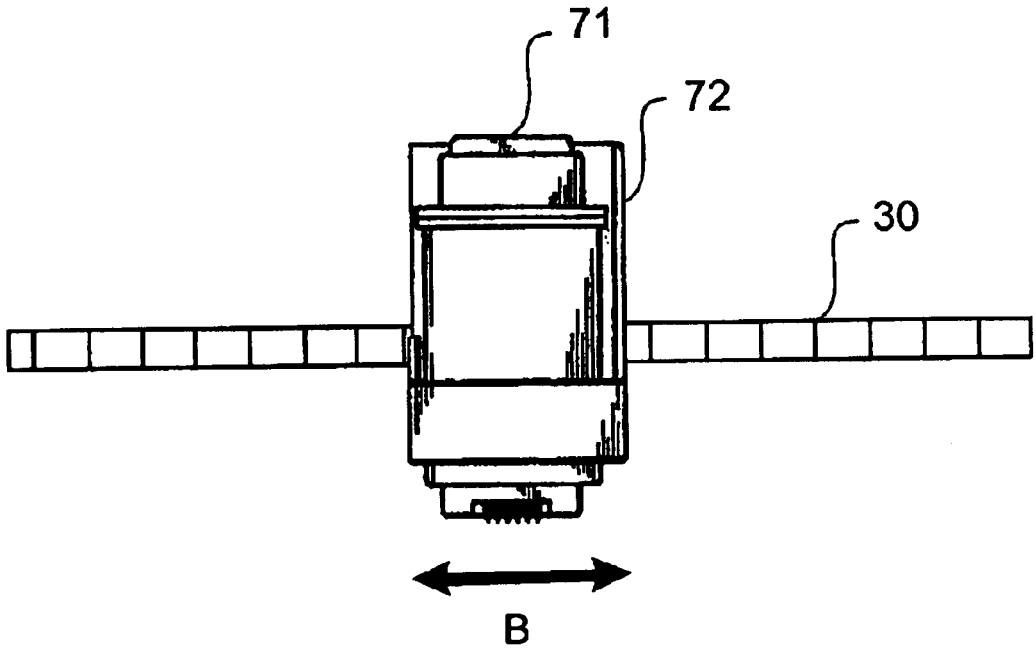
FIG. 7 is a front view showing a carrier and an ink cartridge mounted on the carrier.

Although this embodiment uses the motor 51 as a driving source for moving the rack 30, it is possible that the rack 30 moves in association with a movement of a carrier 72 (shown in FIG. 7 ) which reciprocates in a direction "B" perpendicular to the sheet discharging direction "A" with an ink cartridge 71 mounted thereon.

According to the present invention as described above, the pair of holders 20*a* and 20*b* move toward and away from each other by the driving of the motor 50, thereby supporting various kinds of sheet having different widths and keeping them elevated above the tray 10.

Also, according to the present invention, since the holders 20*a* and 20*b* stretch from a position where the holders 20*a* and 20*b* are received in the case 100 to the sheet discharging direction "A" to support the paper "P" as the first and the second levers 40*a* and 40*b* pivot, a size of the printer body can be reduced.

Furthermore, according to the present invention, since the holders 20*a* and 20*b* are received in the case 100 when the printer stands by to print a sheet, damages generated by an external shock can be prevented.

Although the preferred embodiment of the present invention have been described, it will be understood by those skilled in the art that the present invention should not be limited to the described preferred embodiment, but various changes and modifications can be made within the spirit and scope of the present invention as defined by the appended claims.

What is claimed is:

1. An apparatus for discharging a sheet, said apparatus comprising:

a tray disposed to receive a printed sheet in a stack;

a holder supporting said printed sheet above said tray, said printed sheet supported by said holder not being in contact with the printed sheet on said tray; and a moving means for horizontally moving said holder in a direction perpendicular to a sheet discharging direction, said moving means comprising a rack reciprocating perpendicular to the sheet discharging direction, said holder moving above the tray in association with a movement of said rack; and a driving means for driving said rack, said driving means comprising a carrier including an ink cartridge, said carrier reciprocating in the direction perpendicular to the sheet discharging direction.

2. The apparatus as claimed in claim 1, further comprised of said driving means comprising;

a motor; and a pinion connected to a shaft of said motor and engaged with said rack, said pinion receiving a motion transferred from said motor and transferring said motion to said rack.

3. An apparatus for discharging a sheet, said apparatus comprising:

a tray disposed to receive a printed sheet in a stack;

a holder supporting said printed sheet above said tray, said printed sheet supported by said holder not being in contact with the printed sheet on said tray;

a moving means for horizontally moving said holder in a direction perpendicular to a sheet discharging direction, said moving means comprising a rack reciprocating perpendicular to the sheet discharging direction;

a driving means for driving said rack; and said holder moving above the tray in association with a movement of said rack; and a lever having a first end and a second end, said first end connected to said holder, said second end connected to said rack, said lever pivoting in association with the movement of said rack.

4. The apparatus as claimed in claim 3, further comprised of:

said holder having a slot, said slot being of an arc shape for guiding a movement of said lever; and said lever having a first gear and a protrusion, said first gear mounted at said second end and engaged with the rack, said protrusion protruding from said first end to be inserted into said slot.

5. The apparatus as claimed in claim 4, further comprising means for elastically biasing said lever to pivot in favor of the sheet discharging direction, said biasing means interposed between said holder and said lever.

6. The apparatus as claimed in claim 5, wherein biasing means is a spring.

7. An apparatus for discharging a sheet, said apparatus comprising:

a tray on which a printed sheet is stacked;

a pair of holders including a first holder and a second holder, said first and second holders mounted respectively on both sides of said tray, said pair of holders holding said printed sheet above said tray, said printed sheet supported by said pair of holders not being in contact with the stacked sheet on said tray; and a moving means for horizontally moving said first and second holders in a direction perpendicular to a sheet discharging direction, said moving means comprising:

a rack reciprocating perpendicular to the sheet discharging direction; and a driving means for driving said rack, said driving means comprising a carrier including an ink cartridge, said carrier reciprocating in the direction perpendicular to the sheet discharging direction.

8. The apparatus as claimed in claim 7, further comprised of said driving means comprising;

a motor; and a pinion connected to a shaft of said motor and engaged with said rack, said pinion receiving a motion transferred from said motor and transferring said motion to said rack.

9. An apparatus for discharging a sheet, said apparatus comprising:

a tray on which a printed sheet is stacked;

a pair of holders including a first holder and a second holder, said first and second holders mounted respectively on both sides of said tray, said pair of holders holding said printed sheet above said tray, said printed sheet supported by said pair of holders not being in contact with the stacked sheet on said tray;

a moving means for horizontally moving said first and second holders in a direction perpendicular to a sheet discharging direction, said moving means comprising a rack reciprocating perpendicular to the sheet discharging direction and a driving means for driving said rack;

a first lever; and a second lever, each of said first and said second levers having a first end and a second end, each said first end connected to said first and said second holder respectively, each said second end connected to said rack.

10. The apparatus as claimed in claim 9, further comprised of:

each of said first and said second holders having a slot, said slot being of an arc shape for guiding a movement of said lever; and each of said first and said second levers having a protrusion protruding from said first end to be inserted into said slot.

11. The apparatus as claimed in claim 10, further comprising means for elastically biasing said first and said second levers to pivot in favor of the sheet discharging direction, said biasing means interposed between said first holder and said first lever and between said second holder and second lever respectively.

12. The apparatus as claimed in claim 11, wherein said biasing means is a spring.

13. The apparatus as claimed in claim 12, further comprised of:

said first lever comprising a first gear mounted on the second end of said first lever and a second gear engaged with said first gear and said rack; and said second lever comprising a third gear, said third gear mounted on the second end of said second lever and engaged with said rack, so that said first lever pivots clockwise on a shaft of said first gear in association with the movement of said rack and said second lever pivots counterclockwise on a shaft of said third gear in association with the movement of said rack.

14. The apparatus as claimed in claim 13, further comprised of said rack having:

a first part having first gear teeth engaging with said second gear; and a second part having second gear teeth engaging with said third gear, a length of said first part is longer than a length of the second part, said second part protruding in the paper discharging direction such that front ends of said first and second holders correspond to each other.

15. An apparatus for discharging a sheet of an ink-jet printer, said apparatus comprising:

a tray on which a printed sheet is stacked;

a pair of opposed and movable holders including a first holder and a second holder, each of said first and second holders holding said printed sheet above said tray, said first and said second holders mounted respectively on both sides of said tray;

moving means for moving said first and second holders according to a width of a printed sheet in such a way that, to drop the printed sheet onto said tray, a distance between said first and said second holders is wider than said width of the printed sheet and, to hold the printed sheet above said tray, the distance between said first and second holders is narrower than the width of the printed sheet, said moving means further comprising a rack reciprocating perpendicular to the sheet discharging direction and a driving means for driving said rack, said first and second holders moving toward and away from each other in association with a movement of said rack; and a pair of levers including a first lever and a second lever, each of said first and second levers having a first end connected to said holder and a second end connected to said moving means.

16. The apparatus as claimed in claim 15, wherein said holders are within the ink-jet printer and are not exposed to the outside of the ink-jet printer when the ink-jet printer is not operated.

17. The apparatus as claimed in claim 15, further comprised of:

each of said first and said second holders having a slot, said slot being of an arc shape for guiding movements of said first and second levers;

said first lever comprising a first gear mounted on the second end of said first lever, a second gear engaged with said first gear and said rack and a first protrusion protruding from the first end of said first holder to be inserted into the slot of the first holder; and said second lever comprising a third gear mounted on the second end of said second lever and engaged with said rack, a second protrusion protruding from the first end of said first holder to be inserted into the slot of the second holder so that said first lever pivots clockwise on a shaft of said first gear in association with the movement of said rack and said second lever pivots counterclockwise on a shaft of said third gear in association with the movement of said rack.

* * * * *